United States Patent [19]

Countee, Jr.

[11] Patent Number: 5,074,462

[45] Date of Patent: Dec. 24, 1991

[54] CARTON HAVING DETACHABLE PROMOTIONAL COUPON ON ITS END CLOSURE

[75] Inventor: Joseph Countee, Jr., Somerset, N.J.

[73] Assignee: Nabisco Brands, Inc., Parsippany, N.J.

[21] Appl. No.: 713,220

[22] Filed: Jun. 11, 1991

[51] Int. Cl.[5] ..... B65D 5/42

[52] U.S. Cl. ..... 229/155; 206/459; 206/831

[58] Field of Search ..... 229/152, 155; 206/459, 206/831; 40/312

[56] References Cited

U.S. PATENT DOCUMENTS

| | | | |
|---|---|---|---|
| 911,884 | 2/1909 | Kyle . | |
| 1,116,043 | 11/1914 | Elliott | 206/831 |
| 1,179,985 | 4/1916 | Wallace | 229/44 R |
| 1,965,769 | 7/1934 | Kraft | 229/152 |
| 2,265,664 | 12/1941 | Markert | 206/831 |
| 3,062,430 | 11/1962 | Rutledge | 229/37 |
| 3,104,795 | 9/1963 | Adams | 229/155 |
| 3,214,075 | 6/1962 | Champlin et al. | 229/16 |
| 3,455,497 | 7/1969 | Gillam | 229/152 |
| 3,606,135 | 9/1971 | Rosenburg, Jr. | 229/37 |
| 3,625,412 | 12/1971 | Rosenburg, Jr. | 229/152 |
| 3,788,540 | 1/1974 | Sammons | 229/72 |
| 3,804,323 | 4/1974 | Bemel | 229/53 |
| 3,866,815 | 2/1975 | Desmond | 229/8 |
| 3,924,740 | 12/1975 | Wood | 206/187 |
| 3,958,744 | 5/1976 | Herglotz | 206/831 |
| 4,042,110 | 8/1977 | Guernsey | 206/831 |
| 4,103,820 | 8/1978 | Mathison et al. | 229/37 |
| 4,108,350 | 8/1978 | Forbes, Jr. | 229/37 |
| 4,232,816 | 11/1980 | Johnson et al. | 206/831 |
| 4,344,533 | 8/1982 | Olsen | 206/459 |
| 4,620,664 | 11/1986 | Kaufman et al. | 229/17 |
| 4,834,240 | 5/1989 | Dagostine | 206/459 |
| 4,872,555 | 10/1989 | Shadrach, III et al. | 206/831 |
| 4,905,831 | 3/1990 | Bagdis et al. | 206/444 |

FOREIGN PATENT DOCUMENTS

| | | | |
|---|---|---|---|
| 664202 | 6/1963 | Canada . | |
| 2210301 | 9/1973 | Fed. Rep. of Germany | 206/459 |

*Primary Examiner*—Gary E. Elkins

[57] ABSTRACT

An integral, detachable, promotional coupon is formed, at least in part, by a hinged tuck flap extending from an inner major end-closure flap of a carton. The coupon may be confined to the hinged tuck flap or it may extend onto a portion of the inner major flap. The hinged tuck flap may be folded down into the carton in a vertical position, perpendicular to the inner major flap or it may be folded back upon the inner major flap in a horizontal position between the inner and outer major flaps. The top major flap may be glued to the inner major flap without affecting the detachable coupon.

12 Claims, 4 Drawing Sheets

CARTON HAVING DETACHABLE PROMOTIONAL COUPON ON ITS END CLOSURE

FIELD OF THE INVENTION

The invention relates to special receptacles or packages with detachable coupons. More in particular, the invention relates to certain cartons having detachable coupons extending from major end flaps.

BACKGROUND OF THE INVENTION

Coupons are valuable marketing devices for producers of consumer items. Value is provided to the consumer and more products, profits and goodwill are generated by the coupons.

The conveyance of the coupons to a specific market is an important consideration. Producers of such consumable items as food and the like try to package the coupons with the product being promoted. The idea is that when the consumer buys the product and opens the carton containing the product, the coupon is delivered. The delivery system for such coupons has been the subject of much research.

Cartons themselves are often vehicles for delivering coupons to consumers. Cartons for such consumable items as food are often made from blanks which are folded, cut and pasted into containers. Coupons may be formed as part of the blank. For example, there are cartons with various types of detachable coupons where the carton has reclosable tab and slot flaps.

U.S. Pat. No. 4,042,110 to Guernsey disclosed a carton having a cover flap 18, tuck flaps 19 and 20 attached to the top flap 18, and detachable panel 21. Detachable panel 21 is attached to tuck flap 19. Panel 21 is removed together with tuck flap 19 along tear line 23. The carton is closed by means of tab 25 and slot 26. However, tab 25 forms part of the detachable coupon 21. Accordingly, when panel 21 is detached, the carton is no longer closeable by means of the slot 26. The carton may be reclosed using tuck flap 20 after removal of detachable panel 21. The detachable coupon 21 is on the outside of the carton. The reference does not teach or suggest a carton where the detachable coupon is attached to an inner major top flap.

U.S. Pat. No. 4,872,555 to Shadrach III et al discloses a carton having major top flaps 23 and 24 and minor top flaps 26 and 27. The inner flap 27 carries printing or marking and extends a substantial distance into the end closure opening. Top major flap 24 has locking tab 30 which fits into slit 31 in top major flap 23. The patent refers to U.S. Pat. No. 3,706,135 as disclosing the inclusion of coupons as part of a major top closure flap. However, the reference teaches away from cartons having a detachable coupon included as part of a major top closure flap. The reference does not teach or suggest a major inner flap having a printed, hinged tuck flap and a slot for resealing the package even after detachment of the coupon-forming hinged tuck flap.

U.S. Pat. No. 4,905,831 to Bagdis et al discloses a magnetic diskette package having cover panel 36 which includes locking flap 42. The free end of the locking flap 44 is in the form of a projecting tab 46 which fits into slot 50 of base panel 30. Panels 40 and 72 are detachable. However, these detachable panels are not hinged tuck flaps which are attached to a major inner flap having a resealing slot.

Some producers have designed cartons with detachable coupons attached to slotless top major flaps. U.S. Pat. No. 3,606,135 discloses an inner major flap as a coupon.

U.S. Pat. No. 1,116,043 to Elliott discloses a carton having an inner royalty coupon 5 attached to the outer edge of outer major end flap 2. An inner flap is not disclosed.

U.S. Pat. No. 3,606,135 to Rosenburg Jr. discloses major inner flap 30 as a detachable coupon which is hinged to front face panel 14 of a carton. In FIG. 11, coupon 70 is of substantially double length. The inner portion 71 of the coupon is hinged to the front wall panel along the perforated tear line 72. An outer portion 75 of the coupon is joined to the inward portion 71 along a fold line or crease 77. Upon removal of the coupons 30 and 70, an inner flap does not remain. In addition, opening of the top major flap 25 tears off side flaps 32 and 33 along tear lines 35 and 36.

U.S. Pat. No. 4,103,820 to Mathison et al discloses a carton having an insert of printed matter. The insert 30 is adhered to the carton blank 10 on top outer major flap 21 at portion 31 by glue. See FIGS. 1 and 2. In the embodiment of FIG. 5, the panels and flaps of the carton blank 52 are modified for a tuck style closure. The insert 53 is adhered to the top outer major flap 54 at portion 55.

U.S. Pat. No. 4,620,664 to Kaufman et al discloses a carton for containing and dispensing an insert. An insert 56, shown as a printed coupon is adhered to the interior surface of tab 52. The insert 56 is attached to tab 54 and extends downwardly into the carton along left side panel 16.

Canadian Patent No. 664,202 (issued June 4, 1963 and assigned to General Mills) discloses a carton having return coupon 54 printed on major overlying flap 44. An area 51 of adhesive resistant material is placed on the first carton flap 40 along the edge 46 so that it will cover the area between the first flap and the outer edge of the second overlying flap 44. The coupon is removed via tear lines 53 and 56. Tear line 53 is formed in the first top closure flap 40 and tear line 56 is formed in the second top closure flap 44.

Other producers have designed cartons having exterior detachable coupons which are not attached to a major flap. U.S. Pat. No. 911,884 to Kyle discloses a carton having a detachable, exterior coupon or tag ($a^5$) which extends laterally from the side margin of one of the side wall flaps ($a^3$).

U.S. Pat. No. 3,062,430 to Rutledge discloses a carton blank having a detachable identification panel 26 secured to side panel 44 at tear line 70.

U.S. Pat. No. 3,924,740 to Wood discloses an article carrier having an telescoping handle structure and an exteriorly disposed detachable promotional tab 54.

U.S. Pat. No. 4,108,350 to Forbes Jr. discloses a one-piece carton and an integral, removable coupon 28 attached along perforated line 29 to an exterior glue flap 26. The exterior glue flap 26 is attached to side wall 17 of the carton.

U.S. Pat. No. 4,344,533 to Olsen discloses a reclosable package having a fifth panel for support of the package from a display. Removable tear strip or panel 54 is attached to back panel 26.

U.S. Pat. No. 1,179,985 to Wallace discloses a box having an end closure flap (a) having tongue ($a^x$) tucked in behind the front side of a rectangular package. Mask-shutter (m) is cut or stamped out on lines ($a^2$). Ligaments ($a^3$) act as hinges for the extended portion (m') of shutter (m). A detachable coupon is not disclosed.

U.S. Pat. No. 3,214,075 to Champlin et al discloses cartons having a coupon (C) attached to its interior side wall 1 by means of adhesive. (column 24, lines 19-24.) An exterior "rip strip" is formed by scores 28 on panel 18.

U.S. Pat. No. 3,788,540 to Sammons discloses a travel envelope for enclosing an airline ticket. The envelope contains both an internal detachable baggage ticket 12 and an internal detachable baggage claim ticket 13.

U.S. Pat. No. 3,804,323 to Demel discloses a shopping bag with detachable coupons 31, 32, 33 on the front or back panel of the bag. In the embodiment of FIG. 3, a patch pocket 37 is located on the outer surface of the bag base 13. A coupon 42 is located within the pocket.

U.S. Pat. No. 3,866,815 to Desmond discloses a carton with a dimensional decorative element formed by folding panel 19 along fold line 19A into face-to-face relationship with panel 17 (column 2, lines 11-18). In addition, the top closure flap 28 is provided with a tuck flap 29.

U.S. Pat. No. 4,834,240 to Dagostein discloses a carton having a premium card 34 which is integrally formed with a glue flap 26 of the carton along a weakened tear line 36. The premium card extends within the container space of the carton in a face-to-face relationship with respect to an adjacent side wall 12. (column 2, lines 49-68.)

The invention described herein provides a distinctive coupon delivery system which offers the flexibility of accommodating various sized coupons without compromising the integrity of the carton, especially a carton which is reclosable.

SUMMARY OF THE INVENTION

The invention provides a coupon delivery system comprising a carton made integral with a coupon. Carton containers for products to be sold to consumers are folded and glued from flat blanks. The blanks can be made of any suitable material well known in the art; however, cardboard is the preferred material. The blank is used to form a box having front and back mutually opposed large panels and smaller mutually opposed side panels. The box is provided with top and bottom closures.

There are two types of assembly contemplated with this invention. The first assembly is where a product is initially packaged and conveyed to the consumer for purchase. In this first assembly, the end closures are glued together. The second assembly contemplated by the invention is where the consumer has reclosed the package. The invention is formed by cutting and scoring the blank which is then folded and gluded into a box. One of the end closures, preferably the top, is used to convey the coupon.

The top end closure has four flaps. There are minor flaps hingedly connected to the opposed sides or minor panels. These "dust flaps" have as their intended purpose to partially enclose the container from the sides. Also on the top end closure are opposed major flaps hingedly attached to the opposed major panels. The first major flap is hingedly connected to a first major panel which can be either the front or the back of the box. The first major flap is the upper or outer most flap once the box is initially assembled.

The first flap is initially glued to the outer surface of the second major flap. The first flap is provided with a tab for insertion into a slot onto the second major flap to enable reclosing of the package by the consumer.

In embodiments of the present invention, the second major flap is formed in the blank stage with a hinged tuck flap. (It should be noted that the major flaps are designed to be substantially wide enough to cover the end closure.) The hinged tuck flap which extends from the second major flap gives the second major flap an appearance which is substantially larger than the container space. The hinge of the tuck flap is thus located somewhere near the point where the second major flap meets the opposed major panel when the second major flap is folded downward over the end closure.

When the dust flaps or minor flaps are folded inwardly over the opening and the second major flap is folded down over the dust flaps, the hinged tuck flap may either be tucked downwardly into the box such that the hinged tuck flap is adjacent the opposed major panel and perpendicular to the major flap or the hinged tuck flap may be nested between the first and second major flaps. In both cases, the first major flap is folded over the second major flap and glued down onto the second major flap to complete the initial assembly.

In embodiments of the invention, the hinged tuck flap is only partially coextensive with the second major flap. The first major flap is intended to overlap the hinged tuck flap such that there are surfaces on the inner side of the first major flap which may be used for gluing to the second major flap without interfering with the hinged tuck flap.

In preferred embodiments, the hinged tuck flap forms the coupon. The coupon may be detached at the hinge. The hinge may be scored or there may be written indicia indicating the detachment point for the coupon. Such indicia may be words to the effect of: "cut along dotted line".

In embodiments of the present invention, the hinged tuck flap may be coextensive with the second major flap. There is no overlap by the first major flap over the hinged tuck flap when the hinged tuck flap is folded into the box so that it is adjacent to the opposed panel and perpendicular to the second major flap. The folding of the tuck flap into the box allows the hinged tuck flap to be much larger than when the hinged tuck flap is folded back upon the second major flap. When initially assembling the carton, the first major flap is glued to the second major flap without the coupon being located therebetween.

The coupon may be formed by the hinged tuck flap, and, if desired, a portion of the second major flap. In the latter embodiments more space is provided for promotional indicia than that provided by just the tuck flap. The demarcation point between the second major flap and the coupon may be provided by a score line or by indicia such as "cut along dotted line".

In preferred embodiments, the second major flap contains at least one slot for receiving a tab extension or extensions of the first major flap. The tab and slot structure provides recloseability to the carton. The demarcation between the coupon and the second major flap is such that the slot will be located on the second major flap and not on the hinged tuck flap or coupon.

DESCRIPTION OF THE PREFERRED EMBODIMENTS

The present invention provides a carton having major flaps hingedly connected to the carton front and back walls, and minor flaps hingedly connected to the carton side walls. The major inner flap comprises an integral, detachable, promotional coupon formed at least in part by a printed, hinged tuck flap. The inner major flap also has at least one slot for resealing the package both before and after detachment of the coupon. The coupon may be confined to the hinged tuck flap or it may extend onto a portion of the inner major flap. In embodiments of the present invention, the hinged tuck flap may be folded down into the box at a vertical position, perpendicular to the inner major flap. In other embodiments, the hinged tuck flap may be folded back upon the inner major flap in a horizontal position between the inner and outer major flaps. In these embodiments, the top major flap may be glued to the inner major flap without affecting the detachable coupon.

Figure 5:
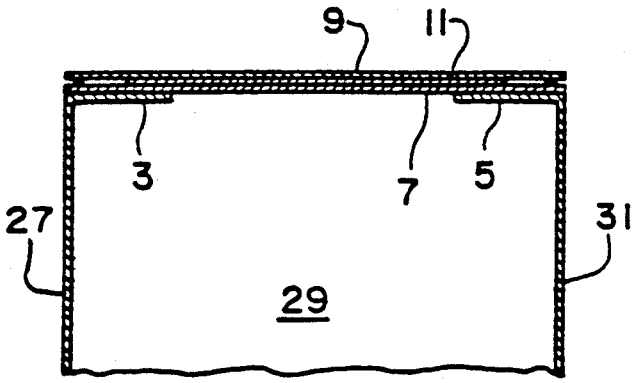
FIG. 5 is a cross-section of FIG. 3 taken along line 5—5.
Figure 6:
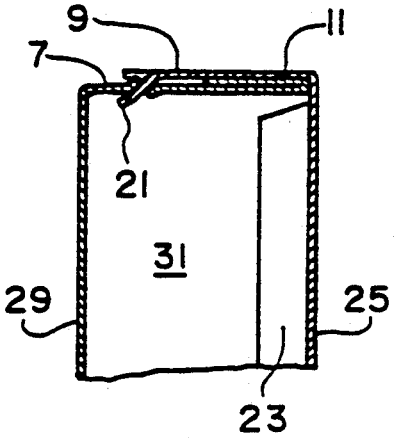
FIG. 6 is a cross-section of FIG. 4 taken along line 6—6.
Figure 7:
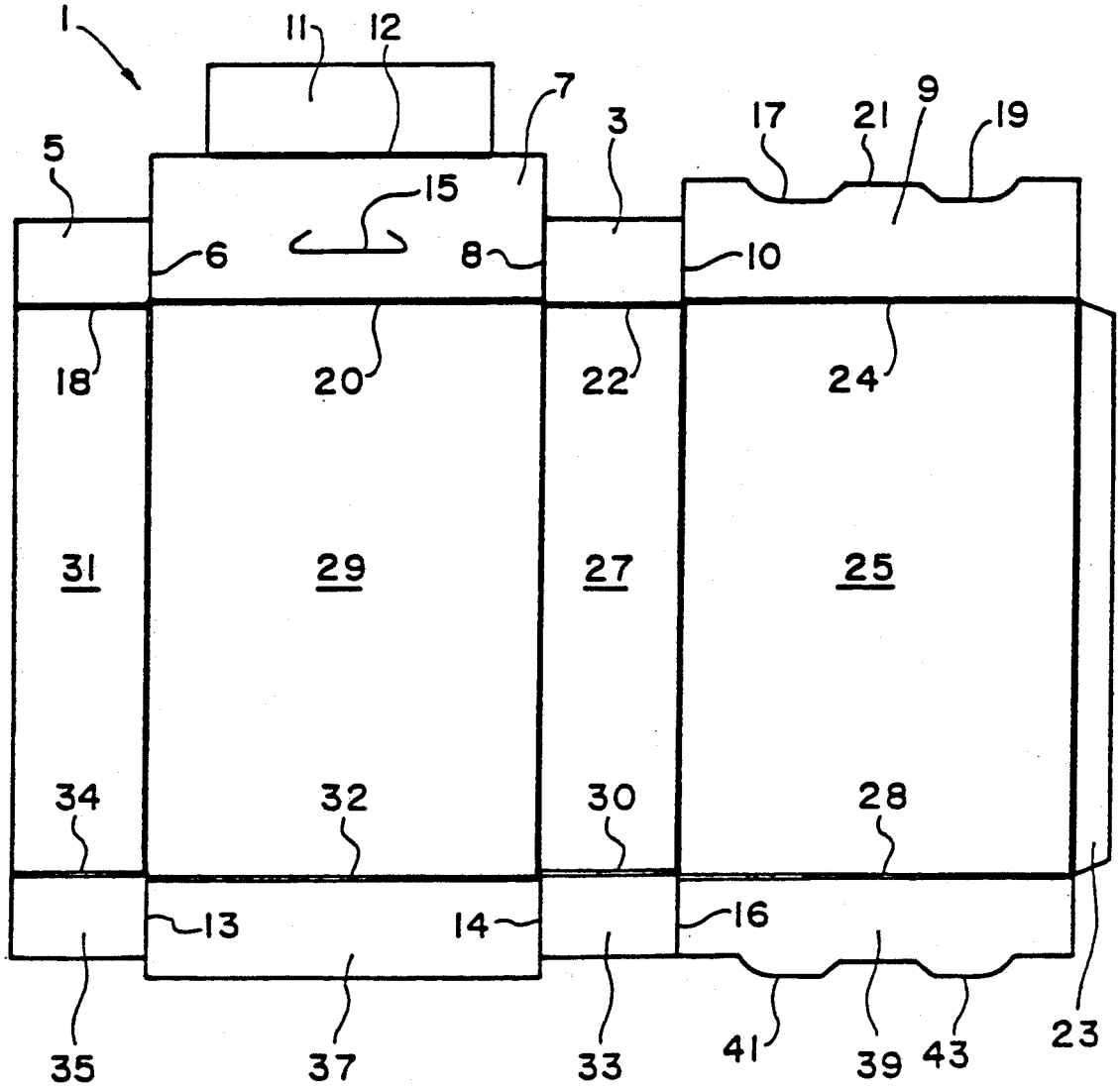
FIG. 7 is a front plan view of a blank used to assemble the embodiment of FIGS. 1-6.

The carton of FIGS. 1-6 is constructed from the blank of FIG. 7. The blank may be cut and scored from cardboard or like material. Blank 1 is provided with first major panel 25, a second major panel 29, a first minor panel or dust panel 27 and a second minor panel or dust panel 31. Additionally, major panel 25 has connecting strip or tab 23 which is glued to the inside surface of minor panel 31 to provide an enclosure.

Figure 1:
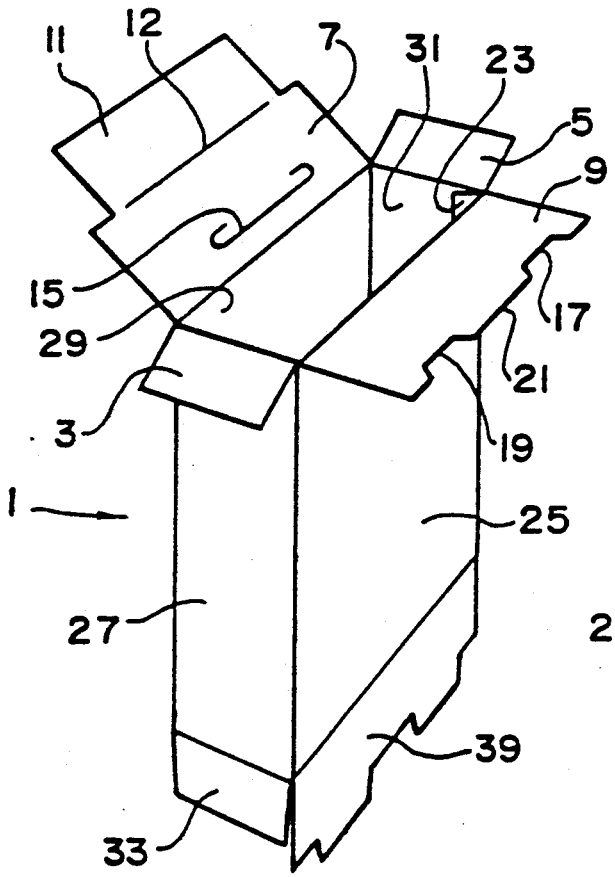
FIG. 1 is an elevated perspective of an embodiment prior to being initially assembled so that the tuck flap is folded back onto the major inner flap.

The blank is essentially cut along the outer lines and inside lines 6, 8, 10, 13, 14, and 16 and folded along the panel boundaries to form a carton having open end closures such as appears in FIG. 1. The end closures for the blank are defined by major and minor flaps. For example, in FIG. 7 the major panel 25 has bottom major flap 39 attached along hinge 28. Minor panel 27 has minor flap 33 attached along hinge 30. Major panel 29 has major flap 37 attached along hinge 32. Minor panel 31 has minor flap 35 attached along hinge 34. The bottom end closure, defined by major flaps 37 and 39 and minor flaps 33 and 35, is initially assembled and is not intended to be disassembled. Thus, minor flaps 33 and 35 are folded via hinges 30 and 34 first over the bottom end closure followed by folding over of major flap 37 via hinge 32. The bottom of the box if finally and permanently enclosed by a folding over of major flap 39 via hinge 28 and gluing it down to a surface of major flap 37. Major flap 39 may be provided with projections 41 and 43 which correspond in shape to indentations 17 and 19 of another carton blank.

The top end closure is defined by major flaps 7 and 9 and minor flaps 3 and 5. Major flap 9 is the outer most flap when the carton is assembled. It is attached to major panel 25 along hinge 24. Major flap 9 is provided with a tab extension 21 situated between indentations 17 and 19. Tab extension 21 is part of the recloseable locking feature. Flap 7 is provided with slot 15 which is designed to receive tab 21.

Flap 7 provides a hinge area 12 for hinged tuck flap 11. Hinged tuck flap 11 is hingedly connected at hinge 12 to major flap 7.

Referring to FIG. 1, the carton is shown partially assembled with both top and bottom end closures in the open positions. The connecting tab or strip 23 is visible through the top of the carton. Tab 23 is a glue area for the assembly of carton 1. The bottom end closure of FIG. 1 is assembled by folding minor flap 33 inwardly with major flap 39 folded over all the other flaps on the bottom and glued down to the inner opposed major flap.

Figure 2:
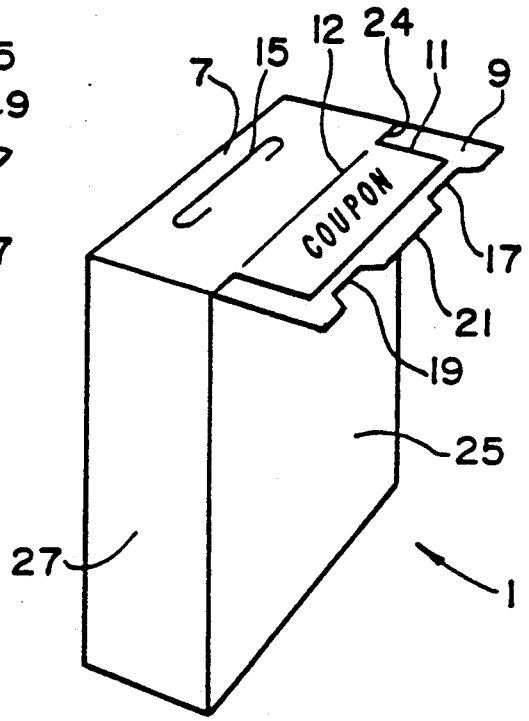
FIG. 2 is an elevated perspective of the embodiment of FIG. 1 partially assembled and showing the position of the coupon.
Figure 3:
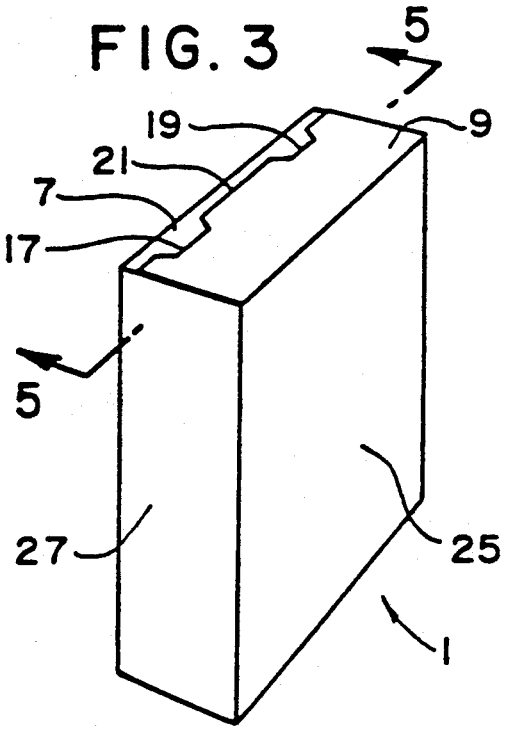
FIG. 3 is an elevated perspective of the embodiment of FIG. 1 as it appears initially assembled.

Initial assembly of the blank of FIG. 7 is shown in FIGS. 1-3. In FIG. 1, minor flaps 3 and 5 are folded inwardly via hinges 22 and 18 over the opening. Whereupon, flap 7 is folded via hinge 20 over the opening to arrive at the appearance of FIG. 2.

In FIG. 2, the hinged tuck flap 11 is shown as forming the coupon. Major flap 9 is shown as overlapping and extending beyond the area of the coupon or hinged tuck flap 11. The purpose of this larger area is to provide surfaces where flap 9 may be glued to a surface of flap 7 for an initial assembly without placing glue upon or otherwise affecting the coupon. Flap 9 is foldable along hinge 24 which coincides with hinge 12 when the flap 9 is closed.

FIG. 3 shows the appearance of the carton after it is initially assembled. The hinged tuck flap or coupon 11 is situated or sandwiched between flaps 7 and 9. Upon opening the fully assembled carton of FIG. 3, the coupon is immediately encountered and easily removed.

Figure 4:
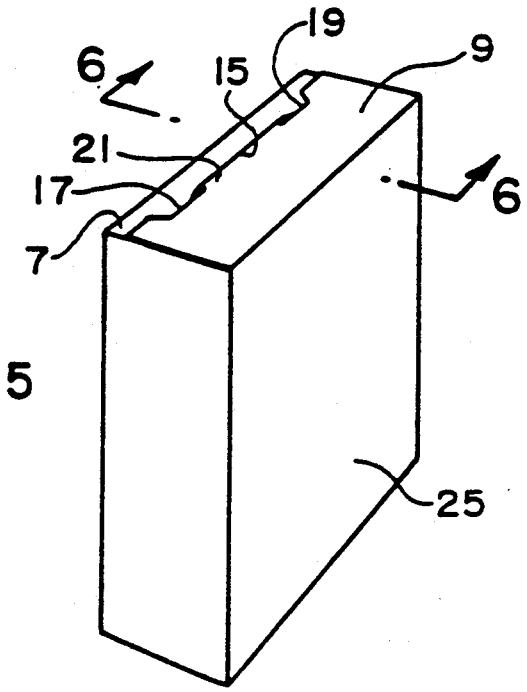
FIG. 4 is an elevated perspective of the embodiment of FIG. 1 as it would appear after having been opened from the initial assembly and then reclosed.

The appearance of the container after the consumer has accessed the contents of carton 1 and reclosed it, as shown in FIG. 4. Tab 21 is seen situated in slot 15, with a major portion of flap 7 being underneath flap 9.

FIG. 5 is a cross-section of FIG. 3 taken at line 5—5. The top end closure, after assembly, comprises the layers as shown in FIG. 5. The inner most layers are opposed minor flaps 3 and 5. Next is flap 7 on top of the minor flaps 3 and 5. Hinged tuck flap 11 is located between the outer most major flap 9 and the inner major flap 7. The dark dots indicate glue points.

FIG. 6 is a cross-section of FIG. 4 taken along line 6-6 and shows the locking arrangement. Tab extension 21 of flap 9 fits underneath major flap 7.

Figure 8:
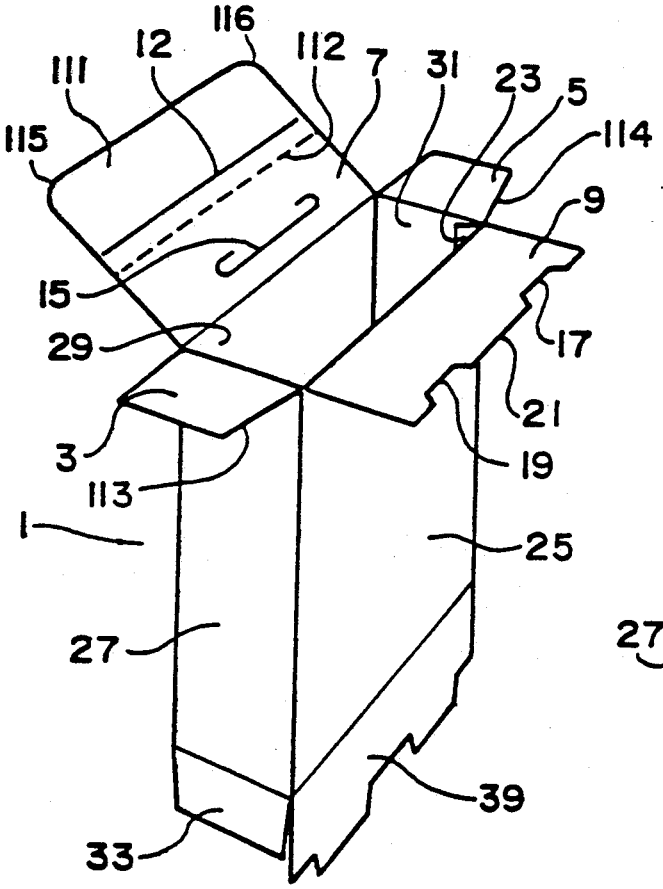
FIG. 8 is an elevated perspective of an embodiment of the present invention where the tuck flap extends the length of the inner major flap and is to be folded perpendicular to the inner major flap.
Figure 10:
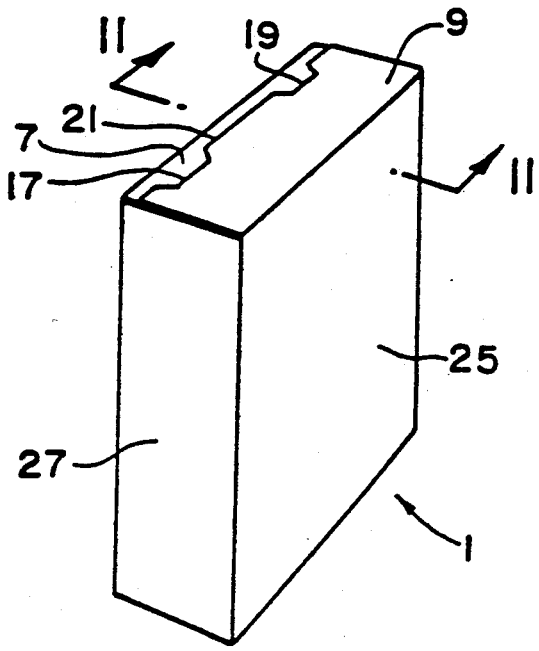
FIG. 10 is an elevated perspective of the embodiment of FIG. 8 as it appears initially assembled.
Figure 11:
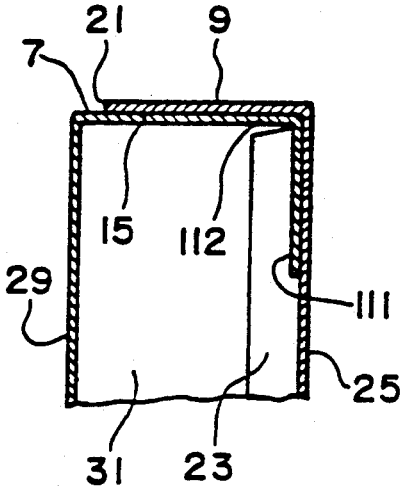
FIG. 11 is a cross-section of the embodiment of FIG. 10 taken along line 11—11.
Figure 12:
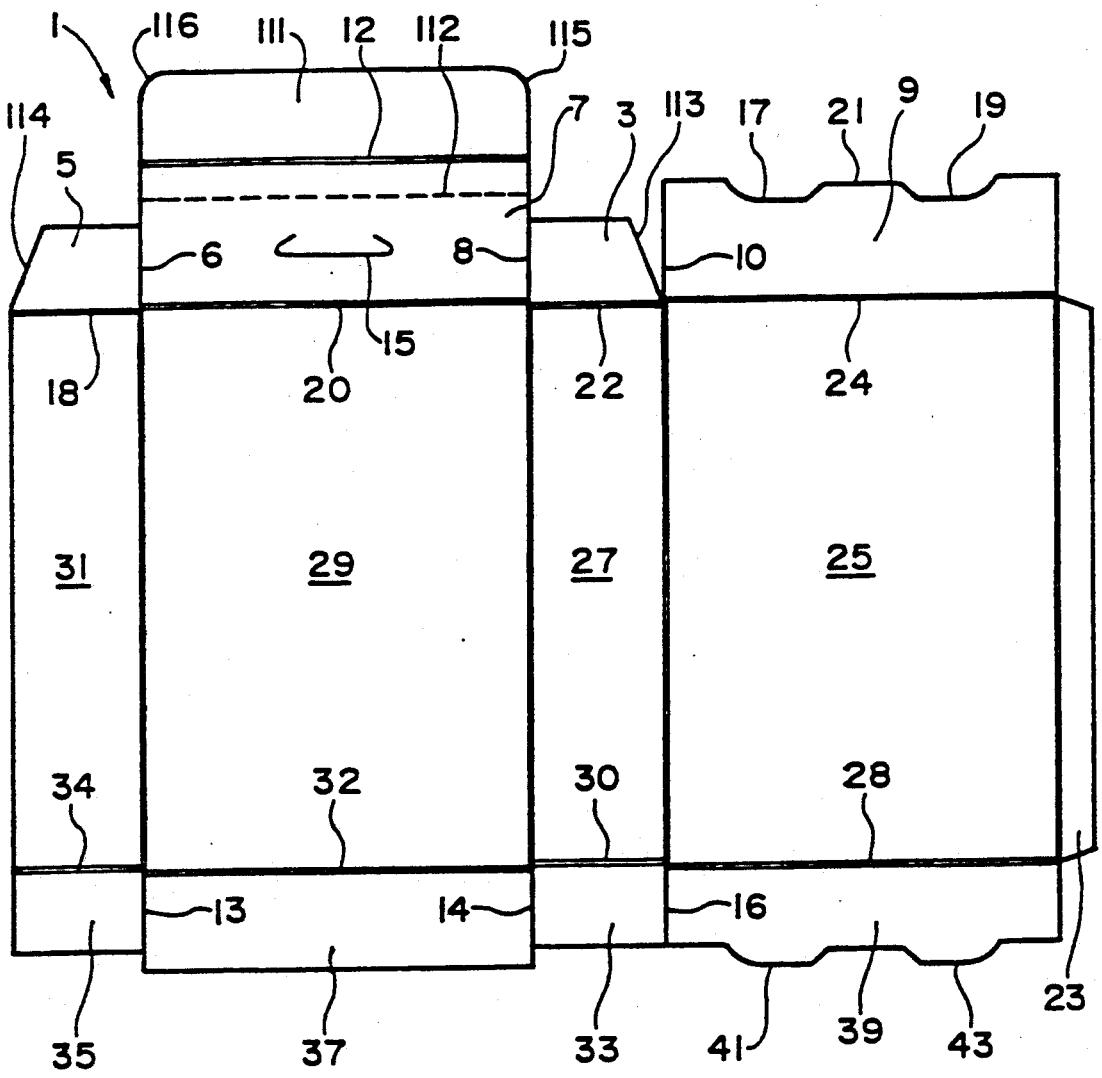
FIG. 12 is a front plan view of a blank used to assemble the embodiment of FIGS. 8-11.

The blank for the carton of FIGS. 8-11 is shown in FIG. 12. The blank is essentially the same as the blank in FIG. 7 except for the structure of major flap 7 and minor flaps 3 and 5. The bottom end closure is the same for both embodiments. In the embodiment of FIGS. 8-11, the hinged tuck flap for major flap 7 is indicated as element 111. The hinge area is still indicated by the number 12. But, unlike the embodiment of FIGS. 1-7, the hinged tuck flap 111 is at least substantially coextensive with major flap 7 such if hinged tuck flap 11 were folded back upon inner major flap 7, it would prevent gluing of the other major flap 9 directly to the inner major flap 7. In addition, as shown in FIGS. 8 and 12 the dust flaps 3 and 5 are preferably tapered from hinges 18 and 22 along the sides 113 and 114 which are not adjacent major flap 7 so as to permit easy insertion of tuck flap 111 into the carton.

The embodiment of FIGS. 8-12 permits the use of larger coupons than does the embodiment of FIGS. 1-7. The larger the coupon, the greater amount of promotional space. In the embodiment of FIGS. 8-12, the coupon area can be provided solely by the hinged tuck flap 111 with the demarcation point being at hinge 12 or the coupon may also include area from a portion of major flap 7 with the demarcation point being line 112. Slot 15 remains intact on major flap 7 regardless of where the demarcation point is for the coupon. The sides of the tuck flap 111 are preferably tapered or rounded at the corner portions 115, 116 of the tuck flap 111 so as to facilitate insertion of the tuck flap 111 into the carton. The sides of the tuck flap 111 may be tapered from the hinge 12.

Referring to FIG. 8, the carton is shown partially assembled with the hinged tuck flap 111 shown as extending from major flap 7.

Figure 9:
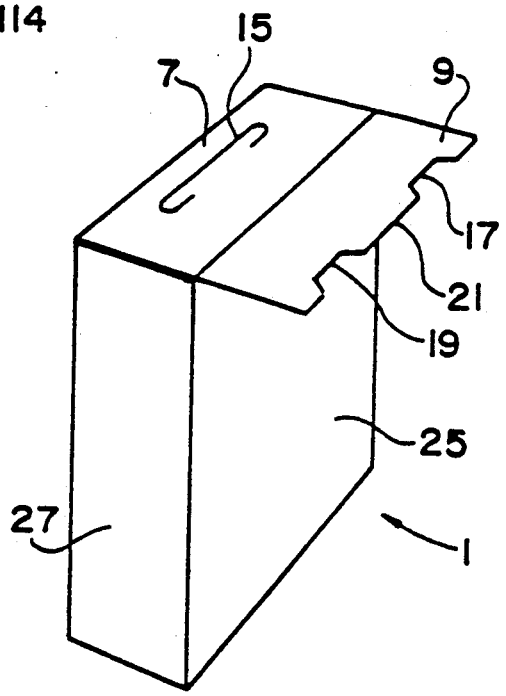
FIG. 9 is an elevated perspective of the embodiment of FIG. 8, partially assembled.

In FIG. 9, the carton is shown being partially assembled with the hinged tuck flap located inside of the carton. Thus, major flap 9 is folded over and onto major flap 7 without the coupon being located therebetween. The fully assembled and loaded carton of FIG. 10, has the same outer appearance as that of the embodiment of FIG. 3 but the inner appearance of the closed cartons is different.

FIG. 11 is a cross-section of FIG. 10 taken at line 11—11. Hinged tuck flap 111 is shown folded into the enclosure such that hinged tuck flap 111 is adjacent and parallel to opposed major panel 25. Hinged tuck flap 111 is also perpendicular to major flap 7. Major flap 9 is shown folded over onto flap 7. Slot 15 is shown being clear of the demarcation point 112 between the coupon and flap 7.

What is claimed is:

1. A carton comprising first and second opposed major panels, first and second opposed minor panels which define a container space and a recloseable end closure, said end closure comprising:

a. first and second minor flaps hingedly connected to said first and second minor panels to partially enclose the container space;

b. first and second major flaps hingedly connected to said first and second major panels to enclose the container space, said first major flap having a tab extending therefrom, said second major flap having a slot for receiving the tab, whereby a secured end closure is provided when the minor flaps are folded inwardly, the second major flap is folded inwardly over the minor flaps, the first major flap is folded inwardly over the second major flap and the tab is inserted into the slot; and c. an integral, detachable, promotional coupon formed at least in part by a tuck flap and being at least partially coextensive with and extending from said second major flap, wherein said tuck flap is foldable within the end closure.

2. The carton of claim 1 wherein the hinged tuck flap is substantially coextensive with the second major flap and is foldable into the container space to be adjacent to the first major panel and perpendicular to the second major flap.

3. The carton of claim 2 wherein the coupon is provided entirely by the hinged tuck flap.

4. The carton of claim 2 wherein the coupon is formed by the hinged tuck flap and a portion of the second major flap, and wherein the slot is not located on said coupon.

5. The carton of claim 4 further comprising indicia on said second major flap separating the second major flap and the slot from the coupon, said indicia providing a detaching area for the coupon.

6. The carton of claim 4 further comprising a score line on said second major flap for separating the coupon from the second major flap and slot.

7. The carton of claim 3 further comprising indicia on the hinged tuck flap separating the second major flap and slot from the coupon, said indicia providing a detaching point for the coupon.

8. The carton of claim 3 further comprising a score line on said second major flap for separating the coupon from the second major flap and slot, whereby the carton is closeable upon removal of the coupon.

9. The carton of claim 1 wherein the hinged tuck flap is partially coextensive with said second major flap and is foldable between said major flaps upon closing while leaving surfaces of said second major flap available for adhesive bonding to said first major flap.

10. The carton of claim 9 wherein the coupon is formed by the hinged tuck flap.

11. The carton of claim 10 further comprising indicia separating the coupon from the second major flap and providing a detaching point for the coupon.

12. The carton of claim 10 further comprising a score line for detaching the coupon from the second major flap.

* * * * *